United States Patent [19]

Le Donne

[11] Patent Number: 4,553,574

[45] Date of Patent: Nov. 19, 1985

[54] VALVE TIP FOR FILLING APPARATUS

[75] Inventor: Giovanni G. Le Donne, Coraopolis, Pa.

[73] Assignee: Horix Manufacturing Co., Pittsburgh, Pa.

[21] Appl. No.: 534,811

[22] Filed: Sep. 22, 1983

[51] Int. Cl.[4] ..... B67C 3/26

[52] U.S. Cl. ..... 141/286; 141/250; 141/392

[58] Field of Search ..... 141/250–270, 141/275–280, 285–286, 296–300, 392, 1, 136, 146–150, 301–310; 277/30

[56] References Cited

U.S. PATENT DOCUMENTS

| | | | |
|---|---|---|---|
| 882,849 | 3/1908 | Strebel | 141/250 |
| 1,793,684 | 2/1931 | Dunn | 141/293 |
| 2,112,199 | 3/1938 | Kantor et al. | 141/287 |
| 2,461,326 | 2/1949 | Kantor et al. | 141/55 |
| 2,591,071 | 4/1952 | Huggins et al. | 141/140 |
| 3,393,491 | 7/1968 | Burton et al. | 141/275 X |
| 3,534,788 | 10/1970 | Vergotti et al. | 141/392 |
| 3,741,263 | 6/1973 | Waxlax | 141/286 X |
| 3,756,290 | 9/1973 | Cleland et al. | 141/275 X |
| 4,235,265 | 11/1980 | Feliks | 141/392 X |

FOREIGN PATENT DOCUMENTS

| | | | |
|---|---|---|---|
| 1327852 | 8/1973 | United Kingdom | 141/286 |

*Primary Examiner*—Stephen Marcus
*Assistant Examiner*—Ernest G. Cusick
*Attorney, Agent, or Firm*—Carothers & Carothers

[57] ABSTRACT

A valve tip seal for a filler valve assembly of a container filling apparatus wherein a hard surfaced sealing member and a resiliently deformable backup member cooperate to permit the sealing member to assume non-aligned orientations with respect to a central tube portion of the filler valve whereby the sealing member is able to provide for effective sealing engagement with a sleeve portion of the valve assembly which encompasses the central tube portion and may assume misaligned orientations with respect to the central tube portion.

7 Claims, 3 Drawing Figures

VALVE TIP FOR FILLING APPARATUS

This invention relates to apparatus for filling bottles or other containers, and more particularly to valve tip structures for the filling valve assemblies of such apparatus.

It is well known in the art of automatic and semi-automatic bottle filling to provide an apparatus wherein a number of downwardly projecting filler valve assemblies are received within the bottles to be filled with liquid product. The filler valve assemblies commonly include a downwardly projecting central tube within which is defined a liquid product flow channel and a vent channel. A sleeve encompasses the central tube and is moveable axially thereof to engage and disengage a valve seal located near the tip or free end of the downwardly projecting central tube. When the sleeve is engaging the valve tip seal, the valve is closed and no liquid product flows therethrough. The prior art is replete with examples of such filling apparatus, U.S. Pat. Nos. 1,793,684, 2,591,071, 2,112,199 and 2,461,326 being exemplary.

Prior valve tip seal arrangements have been subject to numerous shortcomings. For example, leakage of liquid product past the closed valve has been a significant problem in terms of cleanup, maintenance and housekeeping considerations, and further in terms of safety considerations when the liquid product is a volatile, flammable, corrosive or toxic substance. Additionally, valve tip leakage results in significant product waste and consequent additional production cost.

Valve tip leaking may result from a variety of causes. For example, in most prior art filling machines of the type specified a small radial clearance is maintained between the sleeve and the central tube in order to ensure reliable, trouble free movement of the sleeve with respect to the central tube during operation; however, this clearance permits a degree of axial misalignment between the central tube and the sleeve, and thus prior seals which were rigidly secured with respect to the central tube were not able to align perfectly for leak free engagement with a slightly misaligned sleeve.

Some prior valve tips for filling machines provide satisfactory sealing initially, but degrade rapidly under service conditions and begin leaking. The only solution for such problems heretofore has been frequent replacement of the valve tip seals. One example of such a prior seal is an O-ring seal with a rigid backup. The lower end of the sleeve overrides the outer diameter of the O-ring thus forcing it into the inner diameter of the sleeve. Over time this seating action tends to cut the O-ring to the detriment of its sealing capability.

The present invention contemplates an improved filling machine valve tip seal which overcomes the above and other problems associated with the prior art. In one preferred embodiment the invention provides for a filler valve tip seal including a rigid sealing washer which is flexibly secured with respect to the central tube so as to be movable with respect thereto to permit alignment of the sealing washer with the sleeve end throughout the range of potential misalignment of the sleeve with respect to the central tube. The sealing washer is provided with a resiliently flexible backup such as an O-ring which permits the sealing washer to float with respect to the central tube, provides sealing against liquid product leakage along certain leakage paths past the valve seal and cushions the repeated closing of the sleeve upon the seal washer to significantly extend seal washer service life.

It is therefore a primary object to this invention to provide an improved valve tip seal for a filling machine wherein a rigid seal washer floats or is movable with respect to the valve tip central tube and is provided with a resiliently flexible backup element for leak free sealing of the filler valve sleeve upon the sealing washer.

Other objects and advantages appear in the following description and claims.

The accompanying drawings show, for the purpose of exemplification without limiting the invention or the claims thereto, certain practical embodiments illustrating the principles of this invention wherein:

Figure 1:
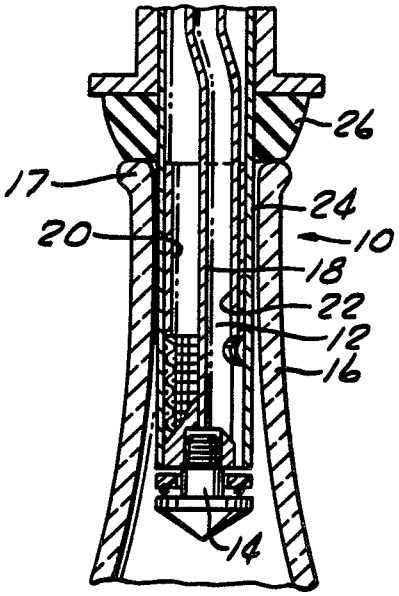
FIG. 1 is a fragmentary, sectional side elevation of a filler valve tip of a filler machine with the valve closed.
Figure 2:
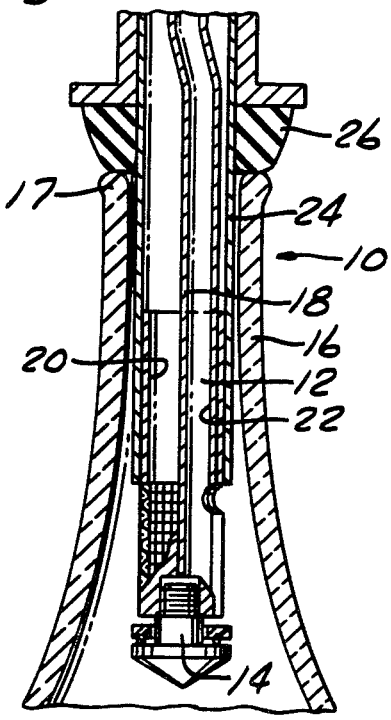
FIG. 2 is a view similar to FIG. 1 but with the valve shown open.

There is generally indicated at 10 in FIGS. 1 and 2 one of a plurality of identical filler valve assemblies of a container filling apparatus. Each filler valve assembly includes an elongated filler valve end portion 12 which includes a filler valve seal means 14 according to one presently preferred embodiment of the instant invention. Each filler valve assembly 10 communicates with reservoir (not shown) containing the liquid product which is commonly to be gravity fed via valve assemblies 10 into containers such as bottles 16 for filling of the bottles 16.

Accordingly, the empty bottles 16 are fed to the filling apparatus in a continuous sequence and each receives within the open end thereof one of the filler valve end portions 12. The end portion 12 of each filler valve assembly 10 includes a central tube 18 within which are defined a liquid product flow channel 20 for directing liquid product into the bottle 16 to be filled, and a vent channel 22 for venting air from the bottle being filled.

A sleeve 24 encompasses central tube 18 and is movable axially thereof for opening and closing the valve assembly 10. Typically, sleeve 24 sealingly engages a low pressure valve seal means 14 under the impetus of an axially directed spring bias force to maintain the valve 10 normally closed as shown in FIG. 1. When the lower end of valve assembly 10 received into bottle 16 for filling thereof, the lip 17 of bottle 16 is forcibly seated against a lip seal member 26 which is secured with respect to sleeve 24. Accordingly, sufficient upward axial force exerted at bottle lip 17 upon lip seal member 26 will overcome the valve closing spring bias to lift sleeve 24 from the normally closed configuration to an open configuration as shown in FIG. 2 whereat the lowermost end 32 of sleeve 24 is separated axially from filler valve seal means 14 and both the filler and vent channels 20, 22 are open to the interior of the bottle 16.

Inasmuch as the above description pertains generally to known filler apparatus, further detailed description thereof is not necessary for an understanding of the present invention by those versed in the art.

Figure 3:
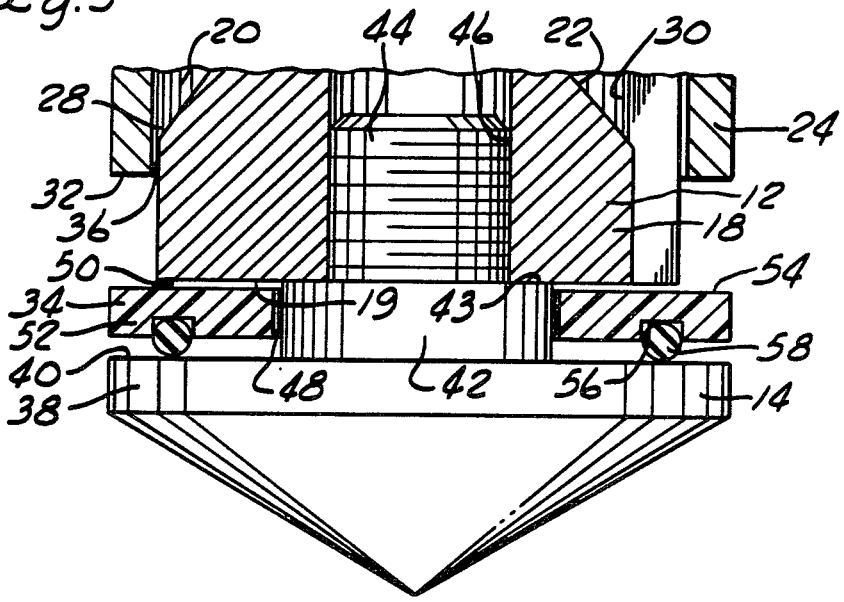
FIG. 3 is an enlarged fragmentary portion of FIG. 2.

In FIG. 3 the filler valve end portion 12 is shown as including central tube 18 wherein are defined an outlet end 28 of liquid product delivery channel 20 and an inlet end 30 of vent channel 22. Sleeve 24 is shown in an intermediate position between the fully open and fully closed positions thereof whereat the lowermost end 32 thereof is spaced axially from a seal assembly 34 of valve seal means 14. Sleeve 24 is of an inner diameter larger than the outer diameter of central tube 18 to provide a radial clearnace 36 therebetween and to thereby ensure smooth and reliable operation of the valve assembly; however, the radial clearance 36 thus provided permits a limited degree of angular misalignment between central tube 18 and sleeve 24. That is, the lower most end 32 of sleeve 24 is intended to present an annular sealing surface which resides in a plane perpendicular to the longitudinal axis of valve end portion 12. The radial clearance 36permits the sleeve 24 to skew slightly with respect to the longitudinal axis of end portion 12 such that the sealing surface 33 is not located in a plane perpendicular to the axis.

To accommodate such misalignment without loss of sealing capability between surface 32 and seal assembly 34, the valve tip sealing means 14 is configured to include a rigid tip member 38 of stainless steel, for exmple, andhaving a relatively enlarged diameter seal supporting shoulder portion 40, a smaller diameter axially extending spacer portion 42 of predetermined axial length and a threaded stud portion 44. Stud portion 44 is threadedly engaged axially within a cooperating tapped bore 46 formed within the lower end of central tube 18 such that an upper shoulder 43 of portion 42 abuts the lowermost end surface 19 of tube 18. Tip member 38 thus captively retains the annular seal assembly 34 intermediate shoulder 40 and the lowermost end surface 19 of central tube 18.Spacer portion 42 is of sufficient axial length that seal assembly 34 is permitted to float or move with respect to central tube 18 sufficiently to accommodate any misalignment between sleeve 24 and central tube 18.

To this end, the inner diameter of seal assembly 34 is of larger diameter than the outer diameter of spacer portion 42 to provide a radial clearance 48 therebeteween and thereby permit a degree of lateral shifting or of angular skew of seal assembly 34 with respect to the longitudinal axis of tube 18. In addition, an axial clearance as at 50 may be provided between seal assembly 34 and the axially spaced confining surfaces 40 and 19 by selecting the axial length of spacer portion 42 to be slightly greater than the overall axial extent of seal assembly 34. The seal assembly 34 is thus able to accommodate skewed misalignment between sleeve 24 and tube 18, within limits, without loss of sealing capability.

The seal assembly 34 is comprised of a rigid sealing washer 52 formed of nylon or hard rubber, for example, and including an annular sealing surface portion 54 which is disposed generally in axial alignment with end surface 32 to mate in sealing engagement therewith upon closing of the valve assembly. An annular recess 56 is formed on the opposite side of washer 52 to receive therein a resiliently deformable backup member 58, a soft rubber O-ring for example. Backup member 58 is deformable under bias, as by the spring bias exerted by sleeve 24 when in contact with washer 52, to permit adjustment of washer 52 to a configuration in alignment with sleeve 24 for effective mating and sealing therewith. Upon lifting of sleeve 24 to open the valve, the backup member 58 will reside from its deformed state thus positioning washer 52 substantially in coaxial alignment with the axis of tube 18. Thus, washer 52 will not retain a misaligned orientation as a result of repeated movement thereof to a misaligned orientation for cooperative sealing with a misaligned sleeve 24. It will be appreciated that the backup member, to be effective, must be capable of differntial resilient deformation between different circumferentially extending portions thereof.

An additional benefit of backup member 58, if it provides a continuous circumferentially extending sealing line as would an O-ring, is that it provides a seal to ensure against leakage of liquid product from the valve tip via the clearances at 50 and 48. Yet another benefit of backup member 58 is the cushioning effect of its ability to deform resiliently under load whereby a shock absorber or bumper effect is provided to cushion the valve closing. This reduces the wear between sleeve end surface 32 and washer 52 upon valve closing and correspondingly extends valve seal life.

According to the description hereinabove there is provided by the instant invention an improved valve tip sealing means for the filler valve assemblies of a container filling apparatus. The improved valve tip sealing mean provides for reduced seal wear and extended seal life, reduced valve leakage, cushioning of valve operation upon closing and other heretofore unavilable benefits through use of a seal assembly combining a rigid seal member and a resiliently deformable backup member retained in a manner so as to be movable for selective alignment with a valve sleeve which may be oriented randomly in any of a number of aligned or misaligned orientations.

A presently preferred embodiment of the invention having been thus described, it is to be understood that the invention may be practiced in various alternative embodiments with numerous modifications without departing from the broad spirit and scope thereof. For example, the general configuration of the filler machine and of the valve assemblies 12 may vary within a wide design latitude, as may be the specific configurations of the liquid flow and vent channels in the valve tip; the valve need not necessarily be solely for a gravity feed apparatus, the seal assembly 52 and individual components thereof may be of various alternative configurations and design subject to the operational constraints and limitations hereinabove specified; specifically, the rigid seal member and the backup member need not necessarily be separate components but may alternatively be a unitary seal and backup element.

These and other embodiments and modifications having been envisioned and anticipated by the inventor, it is intended that the inventions be construed as broadly as permitted by the scope of the claims appended hereto.

I claim:

1. In a container filling apparatus wherein a filler valve assembly includes a central tube portion and a coaxial sleeve portion which is movable axially with respect to said central tube portion into biased engagement with a valve tip sealing means for selectively closing the filler valve assembly, said valve tip sealing means comprising:

a rigid seal member adapted to present a seal surface for engagement with a mating surface of such sleeve portion;

securing means cooperable with such central tube portion for captively retaining said rigid seal member with respect to such central tube portion with said seal surface positioned for such biased engagement thereof by such sleeve portion;

resiliently deformable backup means captively retained with respect to said rigid seal member to support said rigid seal member in a manner that said deformable backup means is resiliently deformable upon biased engagement of said rigid seal member by such sleeve portion; and said rigid seal member being movable with respect to such central tube portion to selected misaligned orientations corresponding to respective misaligned orientations of such sleeve portion with respect to such central tube portion by deformation of said backup member in response to a bias of said sleeve portion upon said rigid seal member whereby said rigid seal member is oriented for effective sealing engagement with such sleeve portion when said valve assembly is closed.

2. The valve tip sealing means as claimed in claim 1 wherein said rigid seal member is movable to axially skewed orientations with respect to such central tube portion.

3. The valve tip sealing means as claimed in claim 2 wherein said rigid seal member is a rigid, hard surfaced washer.

4. The valve tip sealing means as claimed in claim 3 wherein said backup means is an annular backup member generally coaxially oriented with respect to said washer.

5. The valve tip sealing means as claimed in claim 4 wherein said annular backup member additionally provides a sealed interface between said rigid washer and said securing means when said valve is closed to preclude leakage therepast.

6. The valve tip sealing means as claimed in claim 4 wherein said annular backup member is a resiliently deformable O-ring.

7. A valve tip seal for the tip of a filler valve of a container filling apparatus comprising:

a rigid sealing member captively retained generally in coaxial relationship with respect to such valve tip intermediate a central tube portion and a valve tip member and adapted to have seated thereon a seating surface of a valve closing sleeve which encompasses said central tube portion and is axially movable with respect thereto to open and close such valve;

said rigid sealing member being movable within predetermined limits to axially skewed orientations with respect to such central tube portion;

resiliently deformable backup means capatively retained adjacent said rigid sealing member in a manner that said backup means is deformable in response to engagement of said rigid sealing member by such valve closing sleeve; and said resiliently deformable means being of such mechanical properties as to accommodate differential resilient deformation thereof in response to misalignment between said rigid sealing member and such sleeve to provide a leak-tight seal between said rigid sealing member and such sleeve when such valve is closed.

* * * * *